United States Patent [19]

Chambers

[11] 4,329,125

[45] May 11, 1982

[54] DISCHARGE VALVE

[75] Inventor: Dale T. Chambers, Dayton, Ohio

[73] Assignee: Copeland Corporation, Sidney, Ohio

[21] Appl. No.: 114,345

[22] Filed: Jan. 22, 1980

[51] Int. Cl.[3] ..... F16K 15/02

[52] U.S. Cl. ..... 417/569; 137/543.17

[58] Field of Search ..... 137/540, 543.17, 543.19, 137/512.3; 417/567, 569, 559, 562, 564; 251/337

[56] References Cited

U.S. PATENT DOCUMENTS

| | | | |
|---|---|---|---|
| 512,369 | 1/1894 | Garis . | |
| 1,407,518 | 2/1922 | Dennedy | 137/543.17 X |
| 1,425,663 | 8/1922 | Lawhead . | |
| 1,476,794 | 12/1923 | Berry . | |
| 1,628,096 | 5/1927 | Worth . | |
| 1,719,572 | 7/1929 | Stoll . | |
| 1,800,185 | 4/1931 | Thrush | 137/543.17 |
| 2,193,243 | 3/1940 | Teeter | 417/569 X |
| 2,366,004 | 12/1944 | Crittenden | 137/543.19 X |
| 2,386,726 | 10/1945 | Tannehill . | |
| 2,900,999 | 8/1959 | Courtot . | |
| 2,930,401 | 3/1960 | Cowan . | |
| 2,949,929 | 8/1960 | Moore . | |
| 3,332,437 | 7/1967 | Hallen . | |
| 3,664,371 | 5/1972 | Schneider . | |
| 3,889,710 | 6/1975 | Brost . | |
| 4,049,017 | 9/1977 | Jones | 137/543.17 X |

FOREIGN PATENT DOCUMENTS

| | | |
|---|---|---|
| 144437 | 4/1950 | Australia . |
| 681798 | 3/1964 | Canada . |
| 452903 | 11/1927 | Fed. Rep. of Germany . |
| 1550254 | 7/1969 | Fed. Rep. of Germany . |
| 940160 | 12/1948 | France . |
| 2100429 | 3/1972 | France . |
| 2366465 | 4/1978 | France . |
| 679079 | 9/1952 | United Kingdom . |
| 697495 | 9/1953 | United Kingdom . |
| 905661 | 9/1962 | United Kingdom . |
| 988894 | 4/1965 | United Kingdom . |
| 995929 | 6/1965 | United Kingdom . |
| 1015412 | 12/1965 | United Kingdom . |
| 1090740 | 11/1967 | United Kingdom . |
| 1199523 | 7/1970 | United Kingdom . |
| 1265497 | 3/1972 | United Kingdom . |
| 1350287 | 4/1974 | United Kingdom . |

OTHER PUBLICATIONS

Excerpt from "Machine Design", (U.S.) vol. 42, p. 146, Nov. 12, 1970.

"A Look at Problem-Solving with Custom-Made Vespel® Parts made by DuPont from high-performance engineering resins".

*Primary Examiner*—William R. Cline

*Attorney, Agent, or Firm*—Harness, Dickey & Pierce

[57] ABSTRACT

There is disclosed an improved discharge valve assembly for compressors utilizing a disc-like pressure responsive discharge valve, the assembly comprising hardened seats on the valve and cylinder head, a compression spring disposed therebetween urging the valve in a closing direction, and a spring guide surrounding the spring and providing a continuous annular stop surface for limiting opening movement of the valve, whereby wear is reduced and valve lift controlled. In an alternative embodiment the assembly operates between the valve and a bridge member rather than the cylinder head.

19 Claims, 2 Drawing Figures

DISCHARGE VALVE

BACKGROUND AND SUMMARY OF THE INVENTION

The present invention relates generally to pressure responsive valve assemblies and more particularly to discharge valve assemblies particularly adapted for use on refrigeration compressors. Although the invention is applicable to rotary and other type compressors, it is disclosed embodied in a reciprocating piston type compressor which can have either single or multiple pistons and can be of either hermetic or accessible hermetic type.

The embodiments of the present invention disclosed herein are particularly suited for use with disc-like lightweight valves of the type disclosed in assignee's copending application, Ser. No. 971,309, filed Dec. 20, 1978 now abandoned in favor of continuation application Ser. No. 219,849, filed Dec. 23, 1980, and constitute improvements over the valve assemblies disclosed therein.

It is a primary object of the present invention to provide a valve assembly having improved biasing means which minimizes wear in the assembly without restricting freedom of movement of the valve and which provides generally better control over the lift of the valve. It is a related object of the invention to provide such an assembly which is relatively simple in construction and easy to manufacture, which is easy to assemble, which is reliable in operation, and which can be retrofit on certain existing compressors previously utilizing different discharge valve assemblies.

Additional advantages and features of the present invention will become apparent from the subsequent description and the appended claims, taken in conjunction with the accompanying drawings.

DESCRIPTION OF THE PREFERRED EMBODIMENTS

Figure 1:
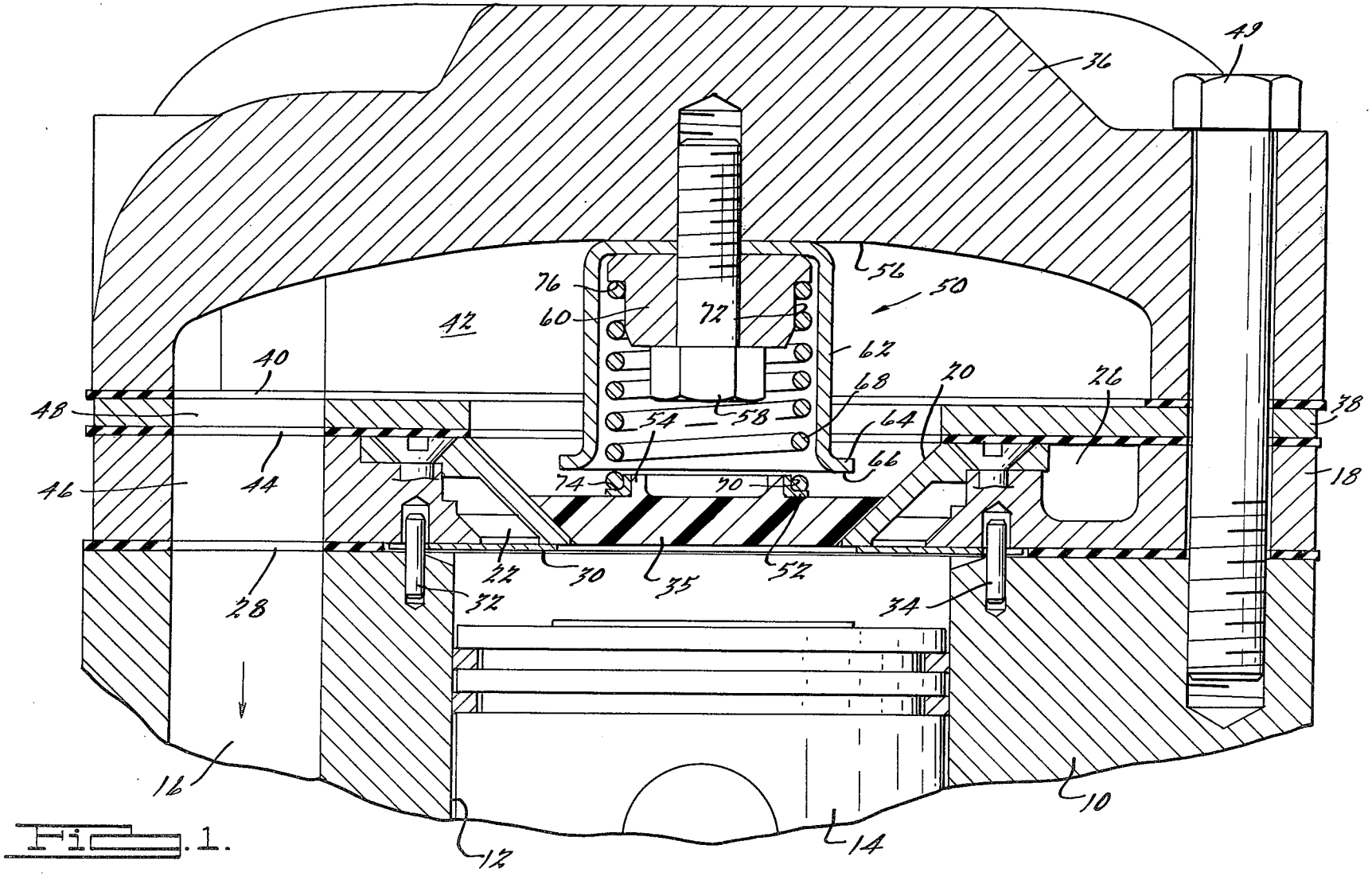
FIG. 1 is a fragmentary sectional view of a portion of a refrigeration compressor embodying the principles of the present invention.

The first embodiment is shown in FIG. 1, wherein there is illustrated a portion of a multi-cylinder, semi-hermetic refrigeration compressor comprising a cylinder block 10 having at least one cylinder 12 therein in which is disposed a conventional reciprocating piston 14 to define the usual pumping chamber, and a discharge gas passage 16 communicating between the upper surface thereof and the compressor discharge line (not shown). Mounted on the upper face of cylinder block 10 is a valve plate 18 having means defining a conical valve seat and discharge passageway 20, and an annular suction gas inlet passageway 22 communicating with a suction gas supply passageway 26, which in turn communicates with the other cylinders in the compressor (if there are any) and the usual supply of suction gas to the compressor (not shown). The details of construction of valve plate 18 form no part of the present invention and are described in assignee's copending application by Robert Anderson entitled "Compressor", Ser. No. 114,346, filed of even date. A suitable gasket 28 is disposed between the valve plate and cylinder block. A conventional ring suction reed valve 30 is located on the lower surface of the valve plate for controlling the flow of suction gas through passageway 22 in the usual manner. Suction valve 30 is positioned in the conventional manner by pins 32 and 34 mounted in cylinder block 10. A suction valve of this general type is illustrated in the aforesaid '309 application.

Valve seat 20 has disposed therein a lightweight compliant polymeric discharge valve 35 of the type described in detail in assignee's aforesaid '309 application. Disposed on the outer surface of valve plate 18 is a cylinder head assembly comprising a cylinder head 36 and a plate 38 disposed on the lower surface thereof, a conventional gasket 40 being positioned between the respective parts. Plate 38 may be a simple metal stamping. Cylinder head 36, in combination with plate 38, defines a discharge chamber 42 communicating with valve seat and discharge passageway 20, plate 38 functioning to separate discharge chamber 42 from suction gas supply passageway 26. A gasket 44 is provided between plate 38 and valve plate 18 to provide the requisite sealing. Valve plate 18 and plate 38 are provided with aligned openings 46 and 48 respectively, which function to place discharge chamber 42 in communication with discharge passage 16 in cylinder head 10. The overall assembly is secured together by means of a plurality of bolts 49 (only one of which is shown) which pass through cylinder head 36, plate 38, valve plate 18, and threadably engage cylinder block 10.

The improved discharge valve assembly of the present invention is generally indicated at 50 and is disposed within discharge chamber 42. The assembly comprises a first annular hardened steel seat 52 mounted on the upper (as shown) or discharge-chamber-face of valve 35. Seat 52 is retained in place by means of an integrally formed annular shoulder 54 on valve 35. Cylinder head 36 is provided with a flat support surface 56 which is parallel to valve 35 and in opposing relationship with respect thereto. Affixed to surface 56 and cylinder head 36 by means of a conventional machine screw 58 is a second annular hardened steel seat 60 and a cylindrical cup-shaped sheet metal spring guide 62 having about the lower surface thereof a radially outwardly projecting flange 64 defining, on the lower surface thereof, a continuous uninterrupted annular stop surface 66 lying in a plane parallel to valve 35 and spaced therefrom a predetermined distance for limiting the opening movement of the valve. A compression coil spring 68 is supported by and compressed between seats 52 and 60 and operates to bias valve 35 in a closing direction. As can be seen, spring guide 62 extends for a substantial portion of the axial length of spring 68 and is in close but spaced proximity thereto. To prevent unnecessary movement, spring 68 and seats 52 and 60 are sized so that the spring is a press-fit over a cylindrical surface 70 on seat 52 and a slip-fit over cylindrical surface 72 on seat 60. Spring 68 has closed and ground ends engaging parallel annular surfaces 74 and 76 on seats 52 and 60, respectively. Spring 68, which is preferably formed of chromium-silicon wire, is provided with approximately two inactive coils at each end for dampening.

The operation of the valve is believed to be self-evident from an understanding of the present disclosure. It should be appreciated, however, that the provision of a full 360° annular stop surface permits accurate lift control of the valve regardless of whether or not it may be tilted when opened under the influence of the pressure differential existing between the pumping chamber and the discharge chamber. Also, because the stop surface is continuous for 360° there is no sharp edge or the like which could wear the top surface of the valve. Furthermore, the close-fit relationships between the compression spring and spring seats restricts spring movement which, along with the hardness of the seats, significantly reduces the possibility of wear. An additional advantage of the embodiment of FIG. 1 over that disclosed in assignee's aforesaid '309 application and the second embodiment herein disclosed, is that the full impact created by opening of the valve in response to pressure forces is taken by the cylinder head, which is of necessarily massive construction. This is to be distinguished from arrangements wherein the valve biasing assembly is supported by a bridge fastened to the upper surface of the valve plate or equivalent, wherein it becomes important to utilize fasteners that will take the full impact of valve opening without loosening.

Figure 2:
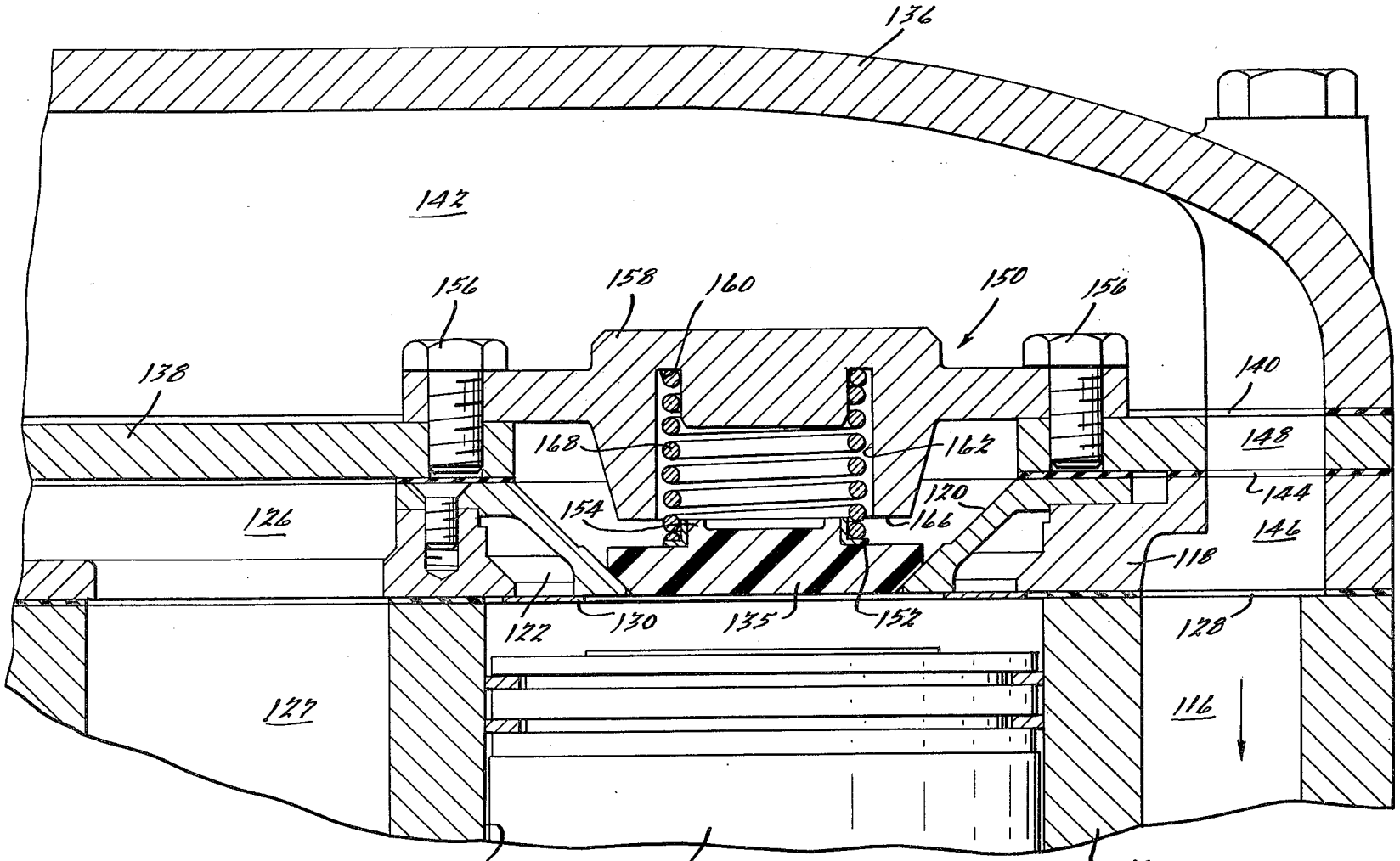
FIG. 2 is a fragmentary sectional view of a second embodiment of a refrigeration compressor embodying the principles of the present invention.

A second embodiment of the invention is illustrated in FIG. 2, wherein there is shown a portion of another multi-cylinder, semi-hermetic refrigeration compressor comprising a cylinder block 110 having at least one cylinder 112 therein in which is disposed a conventional reciprocating piston 114, and a discharge gel passage 116 communicating between the upper surface thereof and the compressor discharge line (not shown). Mounted on the upper face of cylinder block 110 is a valve plate 118 having means defining a conical valve seat and discharge passageway 120, and an annular suction gas inlet passageway 122 communicating with a suction gas supply passageway 126, which in turn communicates with the other cylinders in the compressor (if there are any) and the usual supply of suction gas to the compressor via suction passageway 127. The details of construction of valve plate 118 are similar to those of the preceding embodiment. A suitable gasket 128 is disposed between the valve plate and cylinder block. A conventional ring suction reed valve 130 is located on the lower surface of the valve plate for controlling the flow of suction gas through passageway 122 as in the previous embodiment (the section through valve 130 in FIG. 2 is at right angles to the section through valve 30 in FIG. 1).

Valve seat 120 has disposed therein a lightweight compliant polymeric discharge valve 135 of the type described in detail in assignee's aforesaid '309 application, although in this embodiment the valve is shown provided with a thicker center portion for increased strength. Disposed on the outer surface of valve plate 118 is a cylinder head assembly comprising a cylinder head 136 and a plate 138 disposed on the lower surface thereof, a conventional gasket 140 being positioned between the respective parts. Cylinder head 136, in combination with plate 138, defines a discharge chamber 142 communicating with valve seat and discharge passageway 120, plate 138 functioning to separate discharge chamber 142 from suction gas supply passageway 126. A gasket 144 is provided between plate 138 and valve plate 118 to provide the requisite sealing. Valve plate 118 and plate 138 are provided with aligned openings 146 and 148 respectively, which function to place discharge chamber 142 in communication with discharge passage 116 in cylinder head 110. The respective parts are fastened together in the same manner as in the preceding embodiment.

The improved discharge valve asssembly of this embodiment of the present invention is generally indicated at 150 and is disposed within discharge chamber 142. The assembly comprises a first annular hardened steel seat 152 mounted on the upper (as shown) or discharge-chamber-face of valve 135. Seat 152 is retained in place by means of an integrally formed annular shoulder 154 on valve 135. Affixed to the upper surface of plate 138 by means of conventional machine screws 156 passing through its two projecting arms is a steel bridge 158 defining an integral hardened annular seat 160 and an integral circular cylindrical spring guide 162 having on the lower surface thereof a continuous uninterrupted annular stop surface 166 lying in a plane parallel to valve 135 and spaced therefrom a predetermined distance for limiting the opening movement of the valve. A compression coil spring 168 is supported by and compressed between seats 152 and 160 and operates to bias valve 135 in a closing direction. As can be seen, spring guide 162 extends for a substantial portion of the axial length of spring 168 and is in close but spaced proximity thereto. Spring 168 and seats 152 and 160 are sized in the same manner as in the preceding embodiment. Spring 168 has closed and parallel ground ends and is preferably formed of chromium-silicon wire, with approximately two inactive coils at each end for dampening.

The second embodiment of the invention is ideally suited for use on multi-cylinder compressors which, during assembly, have inclined cylinders, because of the simplified assembly techniques that can be used. In this embodiment the entire valve assembly may be preassembled and positioned on the cylinder block on an assembly line prior to assembly of the cylinder head, which is a relatively heavy, difficult-to-handle part. This is possible because in conventional assembly, locating pins are utilized between valve plate and cylinder block, and in this embodiment plates 138 and 118 can be positioned on the cylinder head and retained in place by such pins even though on an inclined surface. The cylinder head may thereafter be assembled and the entire assembly bolted down in the usual manner, as described above in connection with the first embodiment.

Thus, there is disclosed in the above description and in the drawings an improved discharge valve assembly which fully and effectively accomplishes the objectives thereof. However, it will be apparent that variations and modifications of the disclosed embodiments may be made without departing from the principles of the invention or the scope of the appended claims.

I claim:

1. In a compressor having a pumping chamber, a discharge chamber, a discharge passageway extending between said chambers, and a disc-like pressure responsive discharge valve in said passageway and movable along a center axis for controlling fluid flow from said pumping chamber to said discharge chamber, an improved discharge valve assembly comprising:

a first annular hardened metal seat on said valve, said first seat being disposed in said discharge chamber when said valve is closed;

means defining an integrally formed annular shoulder on said valve, said shoulder positioning said first annular seat coaxially about and in a plane transverse to said axis, said valve having a greater thickness in the axial direction in the portion at said annular shoulder than in a peripheral position outside said shoulder;

support means having a second annular seat disposed in facing parallel and coaxial relationship with said first seat;

a compression spring supported by and compressed between said seats and biasing said valve in a closing direction; and means defining an annular stop surface on said support means lying in a plane transverse to said axis, said stop surface being spaced a uniform predetermined distance from said valve for limiting the opening movement thereof.

2. The discharge valve assembly as claimed in claim 1, wherein said valve is formed of a polymeric material.

3. The discharge valve assembly as claimed in claim 1, wherein said spring is a coil spring and said first seat has an axial height at least as great as the approximate diameter of one coil of said spring.

4. The discharge valve assembly as claimed in claim 4, wherein said first seat has a transverse width at least as great as the approximate diameter of one coil of said spring.

5. The discharge valve assembly as claimed in claim 1, wherein said spring is a coil spring and said first seat has a transverse width at least as great as the approximate diameter of one coil of said spring.

6. The discharge valve assembly as claimed in claim 1, wherein said spring is a coil spring and each of said seats includes an axially extending cylindrical surface in close-fit engagement with an end coil of said spring.

7. The discharge valve assembly as claimed in claim 1, wherein said valve has a greater thickness in the axial direction in the center portion thereof disposed within said annular shoulder than in the peripheral portion disposed outside said shoulder.

8. The discharge valve assembly as claimed in claim 1, further comprising a cylindrical spring guide surrounding said spring in closely spaced relationship thereto, said annular stop surface being disposed on said spring guides.

9. The discharge valve assembly as claimed in claim 1, wherein said annular stop surface is continuous and uninterrupted.

10. The discharge valve assembly as claimed in claim 1, wherein said valve is formed of a compliant material.

11. The discharge valve assembly as claimed in claim 1, wherein said spring is a coil spring and each of said seats includes an axially extending cylindrical surface engaging a coil of said spring and a transversely extending annular surface against which the end of said spring abuts.

12. The discharge valve assembly as claimed in claim 1, further comprising head means defining said discharge chamber, said second seat and said annular stop surface being supported by said head means.

13. The discharge valve assembly as claimed in claim 1, wherein said compressor also comprises a suction fluid inlet passageway in communication with said pumping chamber and a plate separating said inlet passageway from said discharge chamber, and further comprising a bridge member affixed to said plate, said second annular seat and said stop surface being supported by said bridge member.

14. The compressor as claimed in claim 1 wherein said discharge chamber, said discharge passageway and said discharge valve form parts of a valve and head assembly and said improved discharge valve assembly further includes a fastener securing said means defining said support means and said means defining an annular stop surface to said valve and head assembly.

15. In a compressor having a pumping chamber, head means defining a discharge chamber, a discharge passageway extending between said chambers, and a disc-like pressure responsive discharge valve in said passageway movable along a center axis for controlling fluid flow from said pumping chamber to said discharge chamber, an improved discharge valve assembly comprising:

a first annular hardened metal seat on said valve, said first seat being disposed in said discharge chamber when said valve is closed;

a second annular seat on said head means in facing parallel and coaxial relationship with said first seat;

a spring supported by and positioned between said seats and biasing said valve in a closing direction;

a guide surrounding said spring and having an annular stop surface lying in a plane transverse to said axis, said stop surface being spaced a uniform predetermined distance from said valve for limiting the opening movement thereof; and a fastener securing said second annular seat and said guide member to said head means.

16. In a compressor having a pumping chamber, head means defining a discharge chamber, a discharge passageway extending between said chambers, and a disc-like pressure responsive discharge valve in said passageway movable along a center axis for controlling fluid flow from said pumping chamber to said discharge chamber, an improved discharge valve assembly comprising:

a first annular hardened metal seat mounted on said valve, said first seat being disposed in said discharge chamber when said valve is closed;

means defining an integrally formed annular shoulder on said valve, said shoulder positioning said first seat coaxially about and in a plane transverse to said axis;

a support surface on said head means in facing relationship to said first seat;

a second annular hardened metal seat mounted on said support surface in facing parallel and coaxial relationship with said first seat;

a compression spring supported by and compressed between said seats and biasing said valve in a closing direction;

a cylindrical spring guide surrounding said spring in closely spaced relationship thereto, said guide being mounted to said head means and extending for a substantial portion of the axial distance between said seats; and means defining an annular stop surface on said guide lying in a plane transverse to said axis, said stop surface being spaced a uniform predetermined distance from said valve for limiting the opening movement thereof.

17. In a compressor having a pumping chamber, means defining a discharge chamber, a discharge passageway extending between said chambers, and a disc-like pressure responsive discharge valve in said passageway and movable along a center axis for controlling fluid flow from said pumping chamber to said discharge chamber, and a plate separating an inlet passageway from said discharge chamber, an improved discharge valve assembly comprising:

a first annular seat on said valve, said first seat being disposed in said discharge chamber when said valve is closed;

support means having integrally formed thereon a second annular seat disposed in facing parallel and coaxial relationship with said first seat, a cylindrical spring guide, and an annular stop surface on said guide lying in a plane transverse to said axis, said stop surface being spaced a uniform predetermined distance from said valve for limiting the opening movement thereof;

a spring supported by and compressed between said seats and biasing said valve in a closing direction, said spring guide surrounding said spring in closely spaced relationship thereto, said guide extending for a substantial portion of the axial distance between said seats; and fastener means affixing said support means to said plate.

18. In a compressor having a pumping chamber, a suction fluid inlet passageway in communication with said pumping chamber, a discharge chamber, a discharge passageway extending between said chambers, a disc-like pressure responsive discharge valve in said passageway and movable along a center axis for controlling fluid flow from said pumping chamber to said discharge chamber, and a plate separating said inlet passageway from said discharge chamber, an improved discharge valve assembly comprising:

a first annular hardened metal seat mounted on said valve, said first seat being disposed in said discharge chamber when said valve is closed;

means defining an integrally formed annular shoulder on said valve, said shoulder positioning said first seat coaxially about and in a plane transverse to said axis;

a bridge member affixed to said plate and having a second annular hardened metal seat disposed in facing parallel and coaxial relationship with said first seat;

spring supported by and compressed between said seats and biasing said valve in a closing direction;

means integral with said bridge member defining a cylindrical spring guide surrounding said spring in closely spaced relationship thereto, said guide extending for a substantial portion of the axial distance between said seats; and means defining an annular stop surface on said guide lying in a plane transverse to said axis, said stop surface being spaced a uniform predetermined distance from said valve for limiting the opening movement thereof.

19. The compressor as claimed in claim 18, wherein said bridge member comprises a pair of arms, said arms being affixed to said plate and said bridge member being supported by said arms.

* * * * *

UNITED STATES PATENT AND TRADEMARK OFFICE

CERTIFICATE OF CORRECTION

PATENT NO. : 4,329,125

DATED : May 11, 1982

INVENTOR(S) : Dale T. Chambers

It is certified that error appears in the above-identified patent and that said Letters Patent is hereby corrected as shown below:

Column 3, line 27, "gel" should read -- gas --.

Column 5, line 19, "4" should read -- 1 --.

Column 8, line 14, add "a" before -- spring --.

Signed and Sealed this

Twentieth Day of July 1982

[SEAL]

Attest:

GERALD J. MOSSINGHOFF

Attesting Officer

Commissioner of Patents and Trademarks